US006367455B2

(12) United States Patent
Hirata et al.

(10) Patent No.: US 6,367,455 B2
(45) Date of Patent: Apr. 9, 2002

(54) FUEL SUPPLY AMOUNT CONTROLLER FOR INTERNAL COMBUSTION ENGINE

(75) Inventors: Yasuo Hirata, Obu; Hidehiko Asama, Toyota, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/766,612

(22) Filed: Jan. 23, 2001

(30) Foreign Application Priority Data

Jan. 25, 2000 (JP) ..... 2000-015802

(51) Int. Cl.[7] ..... F02M 37/04
(52) U.S. Cl. ..... 123/497
(58) Field of Search ..... 123/497, 511

(56) References Cited

U.S. PATENT DOCUMENTS

| | | | | |
|---|---|---|---|---|
| 5,044,344 A | | 9/1991 | Tuckey et al. | 123/497 |
| 5,398,655 A | * | 3/1995 | Tuckey | 123/497 |
| 5,411,002 A | * | 5/1995 | Smitley | 123/497 |
| 5,505,180 A | * | 4/1996 | Otterman et al. | 123/497 |
| 5,586,539 A | * | 12/1996 | Yonekawa et al. | 123/458 |
| 5,651,347 A | | 7/1997 | Ol et al. | 123/497 |
| 5,673,670 A | * | 10/1997 | Powell et al. | 123/463 |
| 5,785,025 A | * | 7/1998 | Yoshiume et al. | 123/497 |
| 6,067,963 A | * | 5/2000 | Oi et al. | 123/458 |

FOREIGN PATENT DOCUMENTS

| | | |
|---|---|---|
| JP | 7-103097 | 4/1995 |
| JP | 11-247734 | 9/1999 |

* cited by examiner

*Primary Examiner*—Thomas N. Moulis
(74) *Attorney, Agent, or Firm*—Nixon & Vanderhye P.C.

(57) ABSTRACT

A pump control means controls a fuel pump so that fuel pressure supplied into the internal combustion engine becomes lower than a predetermined fuel pressure regulated by a fuel pressure regulator when the operating state of the internal combustion engine is within a predetermined operating state. Thus, the fuel pressure has already been controlled low while the engine state is within the predetermined operating state, so that the fuel leak from the injector during an engine stop is suppressed, thereby reducing an exhaust of deleterious gas when the engine starts again. Further, since the fuel pressure is decreased while the engine works, electric power is not wasted for decreasing the fuel pressure.

10 Claims, 8 Drawing Sheets

FUEL SUPPLY AMOUNT CONTROLLER FOR INTERNAL COMBUSTION ENGINE

CROSS REFERENCE TO RELATED APPLICATION

This application is based on and incorporates herein by reference Japanese Patent Application No. 2000-15802 filed on Jan. 25, 2000.

BACKGROUND OF THE INVENTION

1. Field of the Invention

The present invention relates to a fuel supply amount controller suitable for use in an internal combustion engine.

2. Description of the Related Art

U.S. Pat. No. 5,044,344 discloses a fuel supply apparatus used for an internal combustion engine. In U.S. Pat. No. 5,044,344, a fuel pump supplies a compressed fuel from a fuel tank to a fuel injector, and the fuel pump works in accordance with electric signals. A check valve is provided between a fuel pump outlet and the fuel injector to prevent the fuel from flowing back from the injector to the pump. A pressure sensor is provided between the pump outlet and the check valve, and connects with an electronic circuit. The electronic circuit feeds an electric energy as a function of pressure inside a fuel supply pipe into the fuel pump. A pressure regulator is provided between the check valve and the engine in the fuel supply pipe. When the pressure inside the fuel supply pipe increases excessively, the excessive fuel returns from the fuel supply pipe into the fuel tank through a return pipe. In this way, the pressure regulator controls the fuel pressure inside the fuel supply pipe to be constant.

However, in U.S. Pat. No. 5,044,344, the fuel pressure is maintained at the pressure set by the pressure regulator while the engine does not work. Thus, when a nozzle of the injector is not sufficiently sealed, the fuel leaks into an intake air pipe, and air-fuel ratio becomes rich at next engine start, thereby exhausting a large amount of deleterious gas, especially hydrocarbon (HC).

Further, a fuel supply apparatus in which a pressure regulator is provided between a fuel pump and a check valve is considered. In this apparatus, a return pipe, which returns excessive fuel from the pressure regulator into the fuel tank, is shortened.

However, in this apparatus, the pressure regulator is provided at the upstream side of the pressure regulator. Thus, even when the fuel temperature and pressure rise at an engine stop, the fuel pressure inside a delivery pipe is continuously high, so that the above-described problem arises.

For solving the problem, U.S. Pat. No. 5,651,347 discloses a fuel supply system in which a fuel pump keeps running within a predetermined period even after an engine stops for decreasing a fuel pressure. However, this system does not include a pressure regulator, and controls the fuel pressure inside the delivery pipe by using a discharge pressure of the fuel pump while the engine works. Thus, the fuel pump needs to be driven even after the engine stops for decreasing the fuel pressure, so that consumed electric power is increased, thereby worsening fuel consumption.

SUMMARY OF THE INVENTION

An object of the present invention is to suppress a fuel leak from an injector when an engine stops, without wasting electric power.

According to a first aspect of the present invention, a pump control means controls a fuel pump so that fuel pressure supplied into the internal combustion engine becomes lower than a predetermined fuel pressure regulated by a fuel pressure regulation means when the operating state of the internal combustion engine is within a predetermined operating state.

Thus, the fuel pressure has already been controlled low while the engine state is within the predetermined operating state, so that the fuel leak from the injector during an engine stop is suppressed, thereby reducing an exhaust of deleterious gas when the engine starts again. Further, since the fuel pressure is decreased while the engine works, electric power is not wasted for decreasing the fuel pressure.

According to a second aspect of the present invention, the pump control means ON/OFF controls the fuel pump. The pump control means estimates fuel pressure based on ON period or OFF period of the fuel pump and an opening period of a fuel injection valve, and controls so that the estimated fuel pressure becomes lower than the predetermined fuel pressure.

Thus, there is no need to use a fuel pressure sensor, thereby reducing a manufacturing cost.

According to a third aspect of the present invention, the pump control means duty-controls the fuel pump. The pump control means estimates fuel pressure based on a driving duty of the fuel pump and an opening period of a fuel injection valve, and controls so that the estimated fuel pressure becomes lower than the predetermined fuel pressure.

Thus, there is no need to use a fuel pressure sensor, thereby reducing a manufacturing cost.

According to a fourth aspect of the present invention, the operating state detection means detects the operating state of the internal combustion engine is an idle operating state. The pump control means controls the fuel pump so that pressure of the fuel supplied into the internal combustion engine becomes lower than the predetermined fuel pressure when the operating state detection means detects the operating state of the internal combustion engine is the idle operating state.

Thus, when the engine stops through the idle operating state, the fuel pressure has already decreased, so that the fuel pressure is decreased without driving the fuel pump after the engine stops. Generally, since the operating state is the idle operating state before the engine stops, the fuel pressure is decreased before the engine stops with certainty.

According to a fifth aspect of the present invention, the operating state detection means detects an opening of a throttle valve. The pump control means controls the fuel pump so that pressure of the fuel supplied into the internal combustion engine becomes lower than the predetermined fuel pressure when the operating state detection means detects the throttle valve is full-closed.

Thus, when the throttle valve is full-closed, for example a vehicle speed is reduced, additional fuel pressure is not charged, thereby improving fuel consumption. When the engine stops after the throttle valve is full-closed, for example a vehicle speed is reduced, the fuel pressure has already been decreased, so that the fuel pressure is decreased without driving the fuel pump. Further, when the engine stops after the vehicle speed is reduced, the fuel pressure acting on the injector is decreased before the engine stops with certainty.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 1:
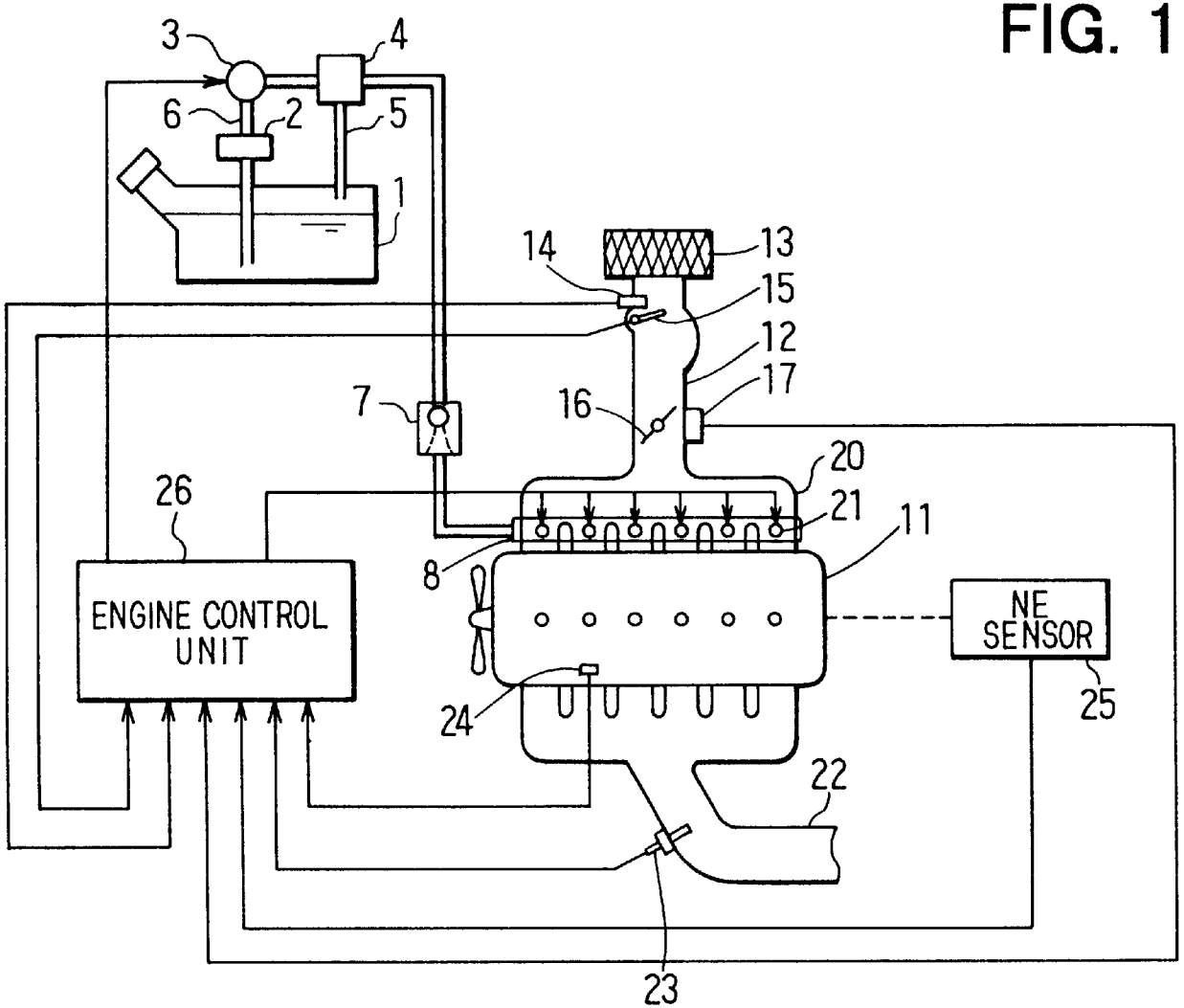
FIG. 1 is a schematic view showing a system of a fuel supply amount controller.

FIG. 1 is a schematic view showing a system of a fuel supply amount controller used for an internal combustion engine. Air-fuel mixed gas is supplied into an engine 11. Intake air flows into an intake manifold 20 through an air cleaner 13 and an intake pipe 12 connected to the engine 11. The air is distributed into each cylinder of the engine 11 in the intake manifold 20. A throttle valve 16 is provided in the intake pipe 12 to adjust the flow amount of the intake air. A fuel pump 3 feeds a fuel stored in a fuel tank 1 into a delivery pipe 8 through a fuel supply pipe 6. Each cylinder has an injector 21 injecting the fuel into the intake manifold 20 to mix the fuel with the intake air. A check valve 7, a fuel filter 2 and a fuel pressure regulator 4 are provided in the fuel supply pipe 6. The check valve 7 prevents the fuel from flowing back from the delivery pipe 8 while the engine 11 does not work. The fuel filter 2 removes unnecessary impurities included in the fuel. The fuel pressure regulator 4 adjusts the fuel pressure to be higher than the atmosphere by a predetermined pressure. When the fuel pressure becomes over the pressure restricted by the pressure regulator 4, excessive fuel returns to the fuel tank 1 through a return pipe 5. The fuel regulator 4 is provided between the fuel pump 3 and the check valve 7.

Figure 2:
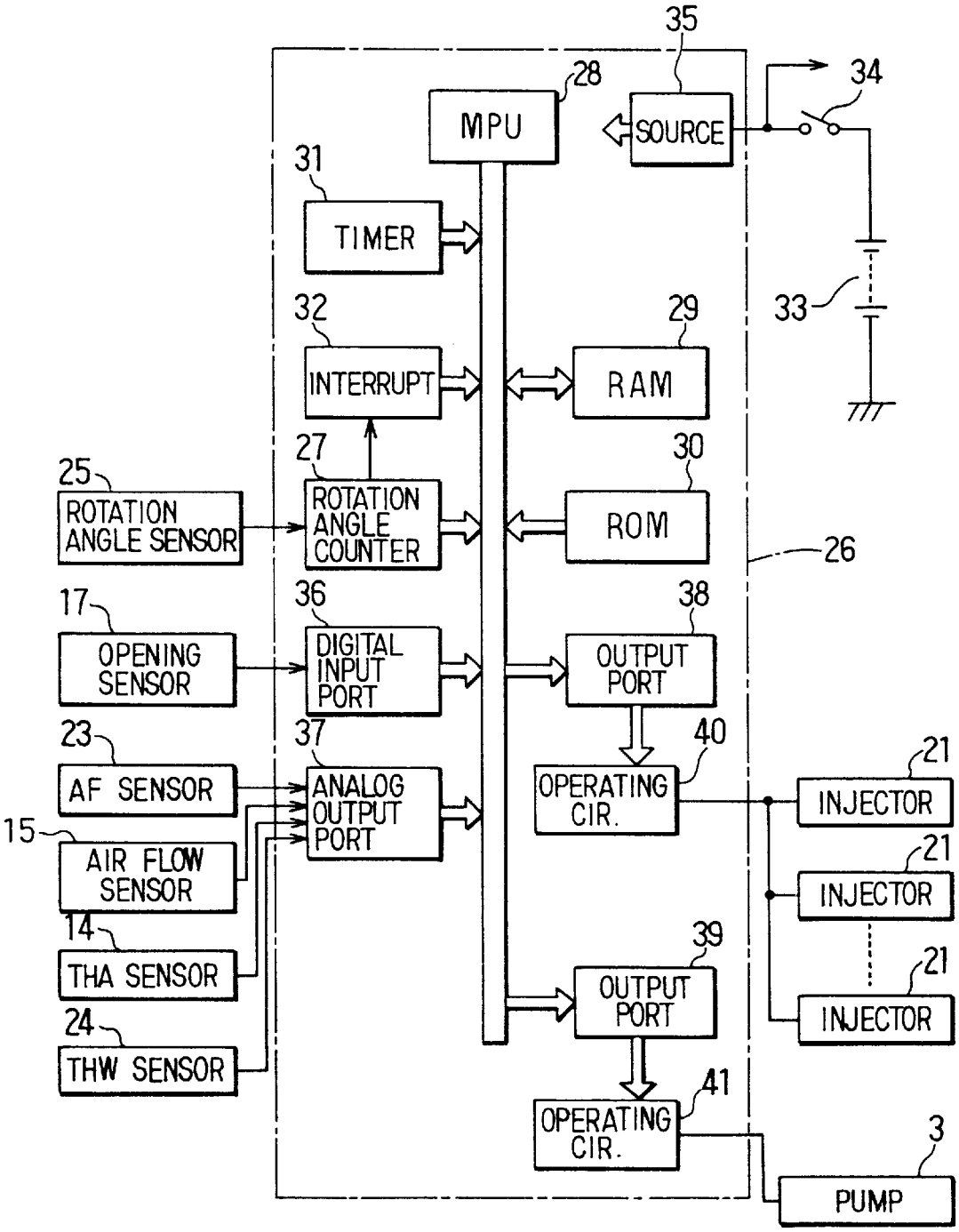
FIG. 2 is a block diagram showing an electronic circuit used for an engine control circuit.

An engine control unit 26 controls the fuel flow amount based on the operating state of the engine 11. The engine control unit 26 receives sensor outputs from air-fuel ratio sensor 23, rotation angle sensor 25, throttle opening sensor 17, coolant temperature sensor 24, air-flow meter 15, intake air temperature sensor 14 and the like, and controls the fuel pump 3 and the injector 21. An electric diagram of the engine control unit 26 will be explained with reference to FIG. 2.

The engine control unit 26 includes MPU 28, RAM 29, ROM 30, digital input port 36, analog input port 37, and output ports 38 and 39. When an ignition 34 is switched on, a vehicle battery 33 is electrically connected to an electric source circuit 35.

The MPU 28 works with a timer 31, a rotation angle counter 27, and an interrupt controller 32. The rotation angle counter 27 counts output signals from the rotation angle sensor 25. The interrupt controller 32 sends, based on the rotation angle counter 27, an interruption request to the MPU 28. The MPU 28 computing processes the sensor signals from the digital input port 36 and the analog input port 37 in accordance with a program stored in the ROM 30, and outputs processed results into the output ports 38, 39. During this processing, the RAM 30 is used as a temporary memory. Commands of the output ports 38, 39 are input into the injector 21 and fuel pump 3 through operating circuits 40, 41. A throttle opening detected by the throttle opening sensor 17 is input into the digital input port 36. Sensor signals from the air-fuel ratio sensor 23, air-flow meter 15, intake air temperature sensor 14, and coolant temperature sensor 24 are input into the analog input port 37. The MPU 28 calculates a rotation speed NE of the engine 11 based on the output signal from the rotation angle sensor 25.

An operation of the present embodiment will be explained with reference to flowchart in FIG. 3. The operation is carried out while the engine 11 has a predetermined operating state. STEP 100 through STEP 130 determine whether the operating state is within a predetermined region or not, based on the several sensor outputs. STEP 100 determines whether rotation speed NE of the engine 11 detected by the rotation angle sensor 25 is under a predetermined speed NE0. When the rotation speed NE is over the predetermined speed NE0, process goes to STEP 190. At STEP 100, when the rotation speed NE is under the predetermined speed NE0, the process goes to STEP 110. STEP 110 determines whether engine load (for example, intake air amount) Egld is under a predetermined load Egld0. When the engine load Egld is over the predetermined load Egld0, the process goes to STEP 190. When the engine load Egld is under the predetermined load Egld0, the process goes to STEP 120. STEP 120 determines intake air temperature THA is under a predetermined temperature THA0. At STEP 120, when the intake air temperature THA detected by the intake air temperature sensor is over the predetermined temperature THA0, the process goes to STEP 190. When the intake air temperature THA is under the predetermined temperature THA0, the process goes to STEP 130. STEP 130 determines whether coolant temperature THW is over a predetermined temperature THW0. When the coolant temperature THW detected by the coolant temperature sensor 24 is under the predetermined temperature THW0, the process goes to STEP 190. When the coolant temperature THW is over the predetermined temperature THW0, the process goes to STEP 140. In this way, STEP 100 through STEP 130 determines whether the engine operating state is within the predetermined range or not.

In the present embodiment, since a fuel pressure sensor is not provided, a follow-up control is carried out. In the follow-up control, a target fuel pressure Pft is attained based on an estimated fuel pressure Pfe. For preventing accidental fire and knocking, STEPS 140 and 150 determine whether air-fuel ratio and air-fuel ratio fuel correction coefficient FAF is within predetermined ranges respectively, based on the output from the air-fuel ratio sensor 23 and air-fuel ratio correction coefficient. STEP 140 determines whether air-fuel ratio detected by the air-fuel ratio sensor 23 is within a predetermined range. When the air-fuel ratio is outside the predetermined range, the process goes to 190. When the air-fuel ratio is within the predetermined range, the process goes to 150. STEP 150 determines whether air-fuel ratio fuel correction coefficient FAF calculated based on the air-fuel ratio is within a predetermined range. When the air-fuel ratio fuel correction coefficient FAF is outside the predetermined range, the process goes to STEP 190. When the air-fuel ratio fuel correction coefficient FAF is within the predetermined range, the process goes to STEP 160.

Here, when air-fuel ratio is rich, the air-fuel ratio fuel correction coefficient FAF corrects basic fuel injection amount to decrease fuel injection amount. When air-fuel ratio is lean, the air-fuel ratio fuel correction coefficient FAF corrects basic fuel injection amount to increase fuel injection amount.

STEPS after STEP 160 shows a flowchart of a control executed based on the estimated fuel pressure Pfe after described. Control pressure is lower than the fuel pressure restricted by the fuel pressure regulator 4. The target fuel pressure Pft includes first target fuel pressure Pft1 and second target fuel pressure Pft2. The first target fuel pressure Pft1 is under the predetermined pressure restricted by the pressure regulator 4, and the second target fuel pressure Pft2 is under the first target fuel pressure Pft1. For controlling fuel pressure between the first and second target fuel pressures Pft1 and Pft2, STEPS after STEP 160 are processed. STEP 160 compares the estimated fuel pressure Pfe with the first target fuel pressure Pft1. When the estimated fuel pressure Pfe is over the first target fuel pressure Pft1, the process goes to STEP 200 to stop the fuel pump 3, When the estimated fuel pressure Pfe is under the first target fuel pressure Pft1, the process goes to STEP 170. STEP 170 compares the estimated fuel pressure Pfe with the second target fuel pressure Pft2. Here, the second target fuel pressure Pft2 is lower than the first target fuel pressure Pft1. When the second target fuel pressure Pft2 is higher than the estimated fuel pressure Pfe, the process goes to STEP 190 to drive the pump 3. When the second target fuel pressure Pft2 is lower than the estimated fuel pressure Pfe, the process goes to STEP 180. STEP 180 determines whether the fuel pump 3 was stopped at one previous routine. If the fuel pump 3 was stopped at one previous routine, STEP 200 stops the pump 3, and if the fuel pump 3 worked, STEP 190 drives the pump 3 continuously. In this way, the estimated fuel pressure Pfe is controlled within a range of the first and second target fuel pressures Pft1 and Pft2 with hysteresis.

Fuel pressure estimation of the present embodiment will be explained with reference to FIG. 4.

Figure 4:
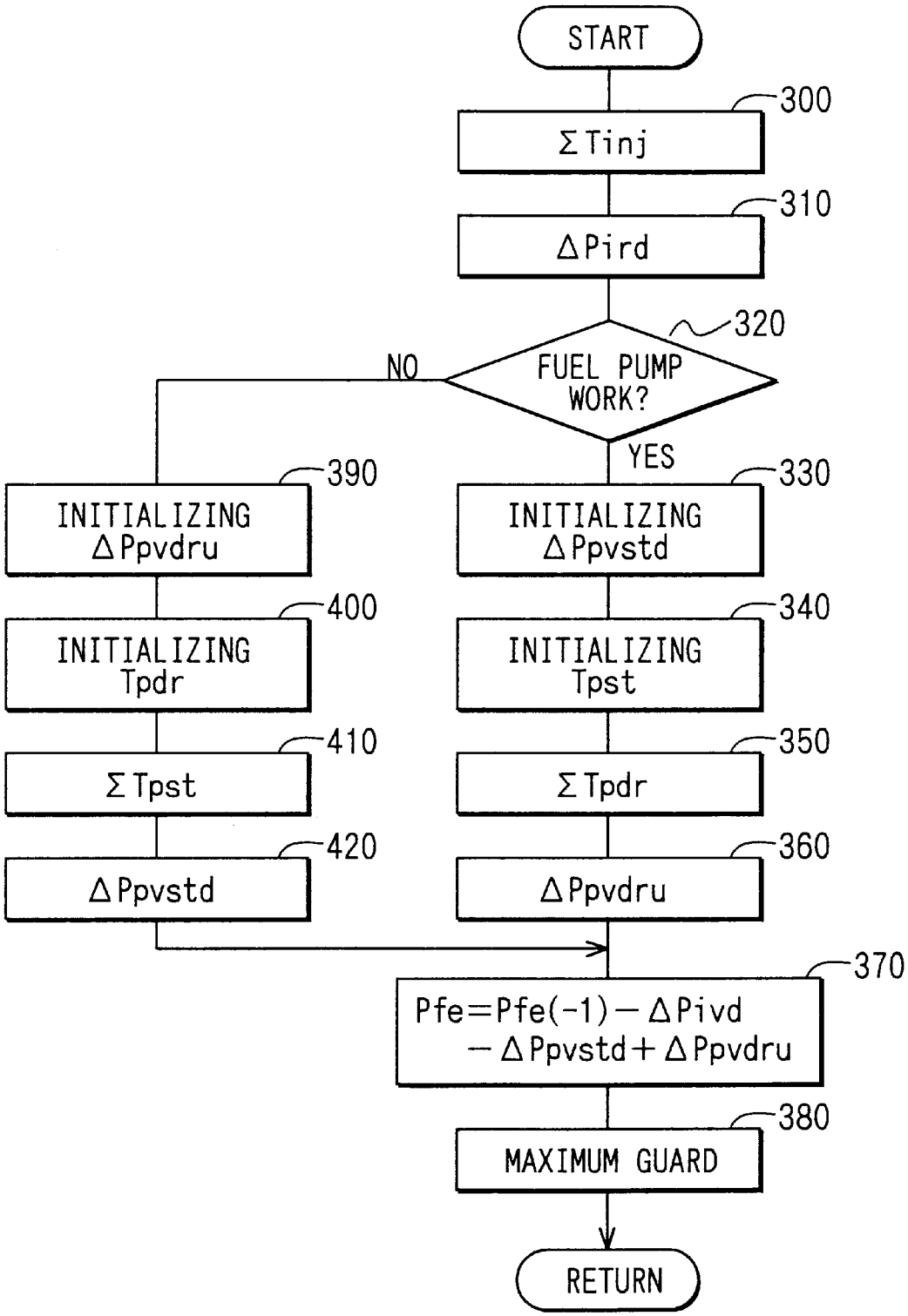
FIG. 4 is a flowchart showing fuel pressure estimation (first embodiment)

The process in FIG. 4 is repeated every predetermined period, and attains a change value within a predetermined period based on fuel pressure change ratio ΔPfr shown in a time-chart in FIG. 5.

STEP 300 calculates a total valve opening time Tinj of the injectors 21 for all cylinders of the engine 11. STEP 310 calculates Injection-Valve-Fuel-Pressure-Down-Value ΔPird of the injector 21 based on the total valve opening time Tinj of the injectors 21 for all cylinders and the estimated fuel pressure Pfe of one previous routine. STEP 320 determines whether the fuel pump 3 works or not. When the fuel pump 3 works, STEP 330 initializes Fuel-Pump-Stop-Fuel-Pressure-Down-Value ΔPpvstd. STEP 340 initializes a counter for counting Fuel-Pump-Stop-Period Tpst. STEP 350 increments a working period counter of the fuel pump 3 orderly to accumulate the counter. STEP 360 calculates Fuel-Pump-Driving-Fuel-Pressure-Up-Value ΔPpvdru based on Fuel-Pump-Driving-Period-Counter-Value Cpdr and the estimated fuel pressure Pfe of one previous routine, and goes to STEP 370.

When STEP 320 determines the fuel pump 3 does not work, the flow goes to STEP 390. STEP 390 initializes Fuel-Pump-Driving-Fuel-Pressure-Up-Value ΔPpvdru, and goes to STEP 400. STEP 400 initializes a working period counter for accumulating Fuel-Pump-Driving-Period Tpdr, and goes to STEP 410. STEP 410 orderly increments the Fuel-Pump-Stop-Period Tpst counter accumulating the Fuel-Pump-Stop-Period Tpst. STEP 420 calculates Fuel-Pump-Stop-Fuel-Pressure-Down-Value ΔPpvstd based on the Fuel-Pump-Stop-Period Tpst counter value and the estimated fuel pressure Pfe of one previous routine.

STEP 370 calculates a current estimated fuel pressure Pfe. The current estimated fuel pressure Pfe is attained by subtracting ΔPivd and ΔPpvstd from the previous estimated fuel pressure Pfe, and adding ΔPpvdru. STEP 380 maximum guard processes the estimated fuel pressure Pfe at a predetermined value, and ends the present routine.

Here, when the fuel pump 3 works at STEP 370, ΔPpvstd is zero. Thus, the current fuel pressure is actually estimated based on the previous estimated fuel pressure Pfe, ΔPivd, and ΔPpvdru. In contrast, when the fuel pump 3 works at STEP 370, ΔPpvdru is zero. Thus, the current fuel pressure is actually estimated based on the previous estimated fuel pressure Pfe, ΔPivd, and ΔPpvstd.

The fuel pressure estimation in the present embodiment will be explained with reference to FIGS. 5A–5G.

Figure 5A:
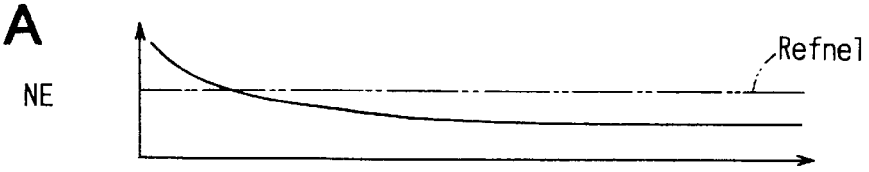
FIGS. 5A–5G are time charts showing fuel pressure control (first embodiment)
Figure 5B:
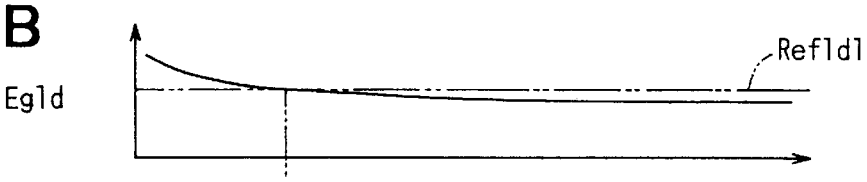

FIG. 5A shows a transition of the rotation speed NE of the engine 11. In FIG. 5A, a low rotation determination value Refnel is indicated. FIG. 5B shows an engine load Egld of the engine 11. In FIG. 5B, a low load determination value Refldl is indicated. When an engine speed NE is under the low rotation determination value Refnel, and an engine load Egld is under the low load determination value Refldl, the control of the present embodiment is started.

Figure 5C:
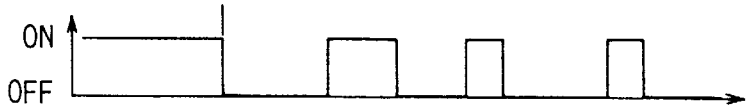

FIG. 5C is a time chart showing ON state and OFF state of the fuel pump 3. When both engine rotation speed NE and the engine load Egld are under the determination values Refnel and Refldl, respectively, the fuel pump 3 does not work. After that, an ON/OFF control is carried out to control the estimated pressure Pfe within a range between the first target fuel pressure Pft1 and the second target fuel pressure Pft2.

Figure 5D:
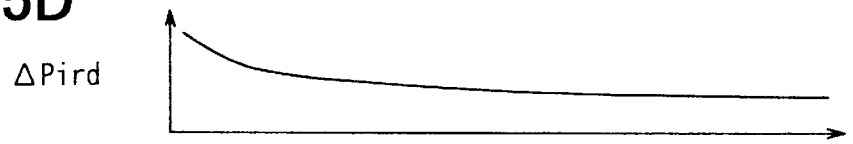

FIG. 5D shows Fuel-Injection-Valve-Fuel-Pressure-Down-Ratio ΔPird. ΔPird includes a pressure down due to the fuel injection, and a fuel pressure down due to the sealing of the injection valve, and a mechanical pressure loss.

Figure 5E:
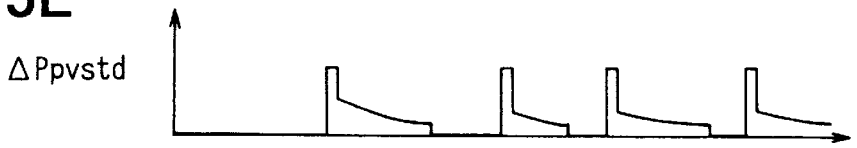

FIG. 5E shows a Fuel-Pump-Stop-Fuel-Pressure-Down-Ratio ΔPprstd. When the fuel pump 3 switched from ON state to OFF state, the Fuel-Pressure-Down-Ratio ΔPprstd is abruptly increased. After that, the Fuel-Pressure-Down-Ratio ΔPprstd temporally becomes constant, abruptly drops, and is decreased gradually.

Figure 5F:
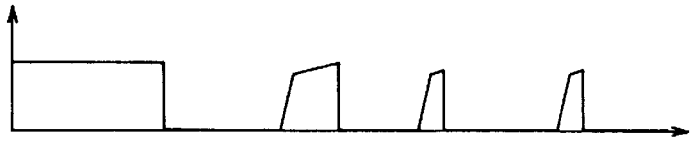

FIG. 5F is a time chart showing Fuel-Pump-Driving-Fuel-Pressure-Up-Ratio ΔPprdru. When the fuel pump 3 is switched from OFF state to ON state, the Fuel-Pressure-Up-Ratio ΔPprdru is gradually increased. When the fuel pump 3 is stopped, the Fuel-Pressure-Up-Ratio ΔPprdru abruptly drops.

Figure 5G:
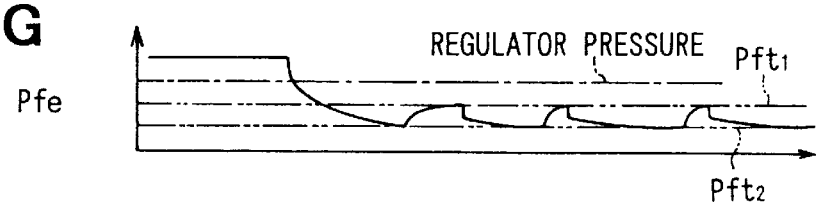

FIG. 5G is a time chart showing the estimated fuel pressure Pfe calculated based on the results of FIGS. 5D, 5E, and 5F. The estimated pressure Pfe is controlled within a range between the first target fuel pressure Pft1 and the second target fuel pressure Pft2.

As described above, in the present embodiment, when the engine 11 works with low rotation speed and low engine load, the fuel pressure is controlled under the pressure restricted by the regulator 4. Thus, even when the engine 11 is stopped, fuel temperature increases, and fuel pressure inside the fuel supply pipe 6 becomes higher than the pressure at the engine stop, the fuel is prevented from leaking to the intake pipe 12, thereby reducing an exhaust of deleterious gas. Further, since the engine 11 does not need a high fuel pressure, and is controlled by a low fuel pressure, consumed electric power is reduced to improve fuel consumption. Further, the engine 11 is controlled by fuel pressure lower than the pressure restricted by the regulator 4, so that the fuel receiving heat from the fuel pump 3 is prevented from returning to the fuel tank 1 through the return pipe 5, thereby reducing fuel evaporation due to rise of the fuel temperature.

Here, the actual fuel pressure may be detected by a pressure sensor provided in the delivery pipe 8 instead of the fuel pressure estimation. In this case, a feedback control is carried out based on the actual fuel pressure and the target fuel pressure.

In the present embodiment, the fuel pressure regulator 4 corresponds to a fuel pressure regulation means. Processes during STEPS 100–150 in FIG. 3 correspond to a operating state detection means. Processes during STEPS 160–200 in FIG. 3 and in FIG. 4 correspond to a pump control means. The coolant temperature sensor 24 corresponds to an engine temperature detection means. The intake air sensor corresponds to an intake air temperature detection means.

Figure 3:
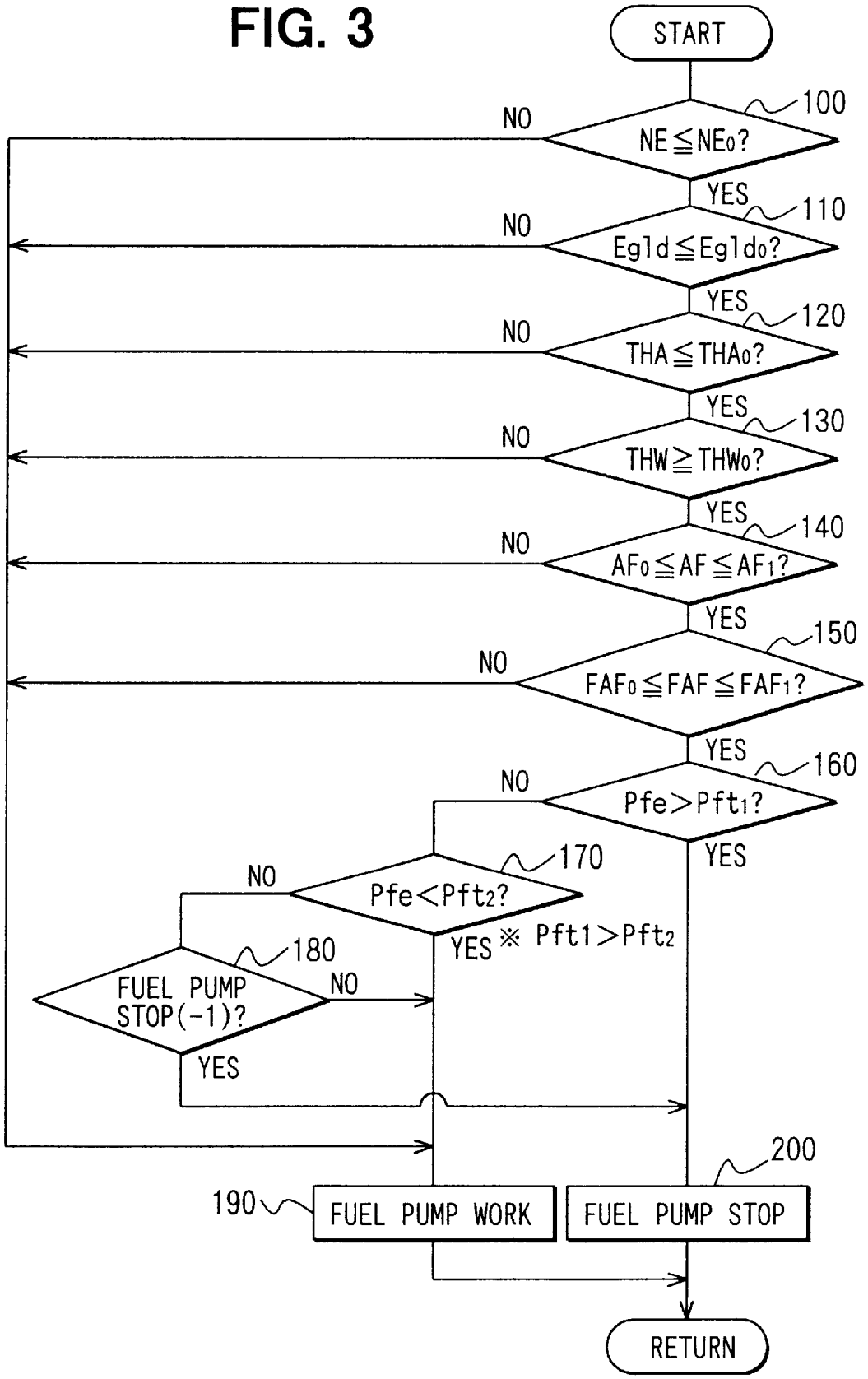
FIG. 3 is a flowchart showing ON/OFF control of a fuel pump (first embodiment)

According to the first embodiment, the rotation speed NE of the engine is determined at STEP 100 in FIG. 3. Alternatively, an idle state of the engine may be detected. In this case, when the idle state is detected, the pump control means at STEPS 160–200 may be used.

Further, alternatively, the throttle opening sensor 17 provided in the intake pipe 12 may determine whether the throttle valve 16 is full-closed or not. In this case, when the throttle valve 16 is full-closed, the pump control means at STEPS 160–200 may be used.

Further, the above-described two procedures may be combined.

(Second Embodiment)

In the second embodiment, Duty-Control controls the fuel pump 3. Processes in the second embodiment will be explained with reference to FIG. 6.

STEPS 100–150 for determining whether the engine operating state is within a predetermined range is the same as in the first embodiment. At STEP 150, when air-fuel ratio fuel correction coefficient FAF is within the predetermined range, PID controller calculates a driving duty to control the estimated fuel pressure Pfe to be a target fuel pressure Pft under the pressure regulated by the fuel pressure regulator 4.

At STEP 150, when the air-fuel ratio fuel correction coefficient FAF is outside the predetermined range, a normal fuel pressure control in which the fuel pressure is controlled to be over the pressure restricted by the regulator 4 is carried out, and the present routine is ended.

Figure 7:
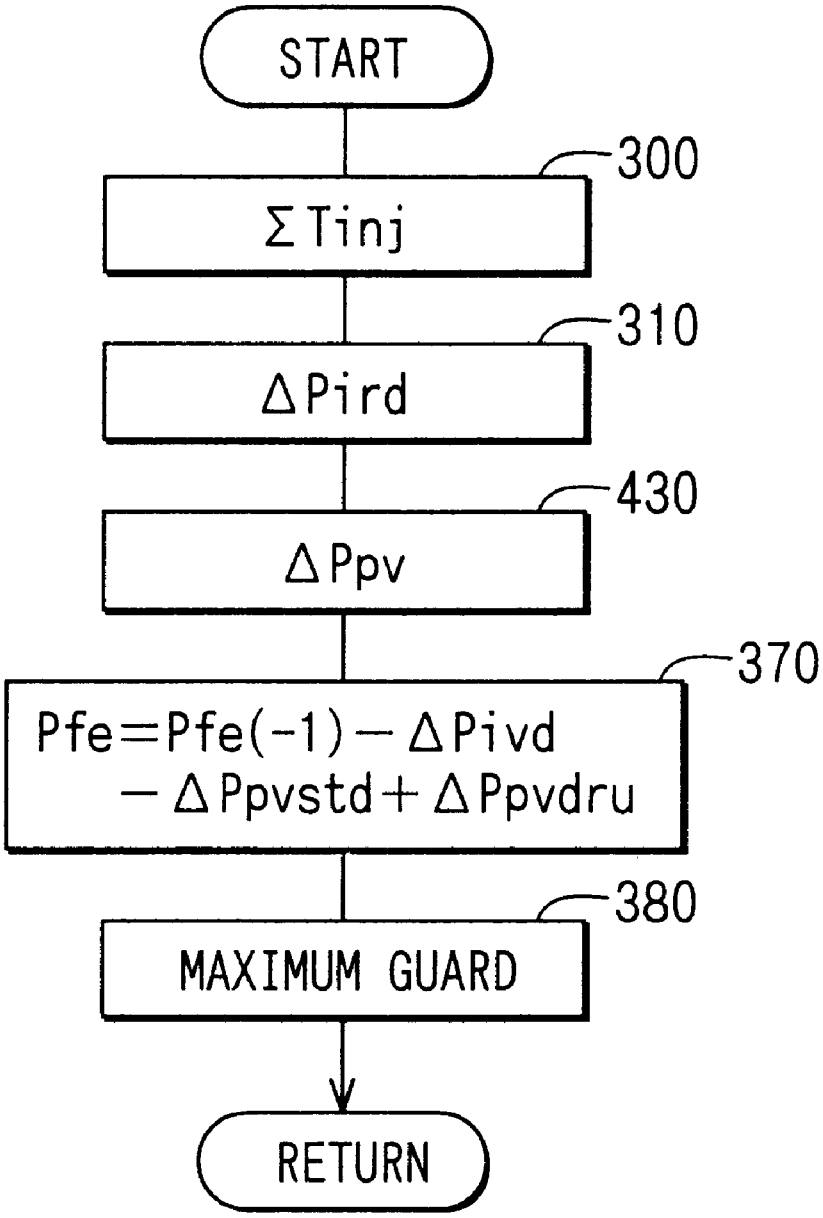
FIG. 7 is a flowchart showing fuel pressure estimation (second embodiment)

The present fuel pressure estimation by the duty control will be explained with reference to FIG. 7. The processes shown in FIG. 7 is repeated every predetermined period, and attains a change value within the predetermined period based on fuel pressure change ratio ΔPfr shown in a time-chart in FIG. 8.

Processes at STEPS 300 and 310 are the same as in FIG. 4. STEP 430 calculates a Fuel-Pump-Fuel-Pressure-Change-Value ΔPpv, based on driving duty value Dutydr at several times previous routine and estimated fuel pressure Pfe(−1) at one previous routine, and goes to STEP 370. Processes at STEPS 370 and 370 are the same as in FIG. 4. In the present embodiment, the processes along this routine estimates the fuel pressure when the duty driving control is used for the fuel pump 3.

The fuel pressure estimation in the second embodiment will be explained with reference to FIGS. 8A–8F.

Figure 8A:
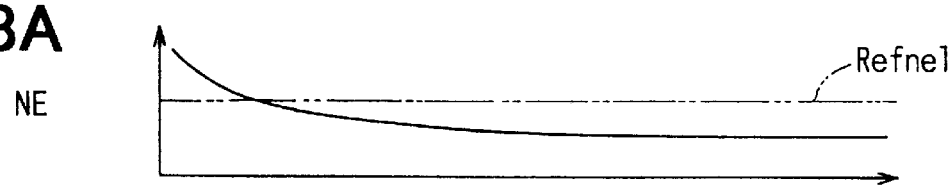
FIGS. 8A–8F are time charts showing furl pressure control (second embodiment).
Figure 8B:
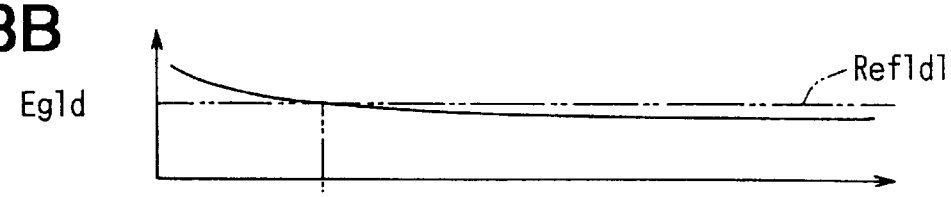
Figure 8C:
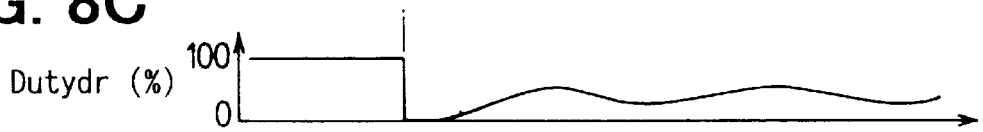
Figure 8D:
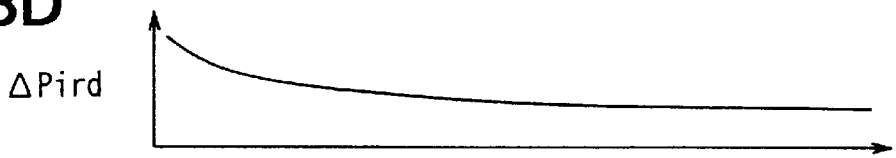
Figure 8E:
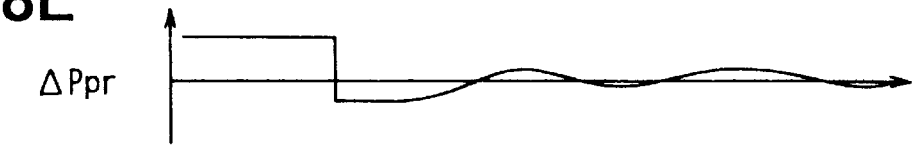
Figure 8F:
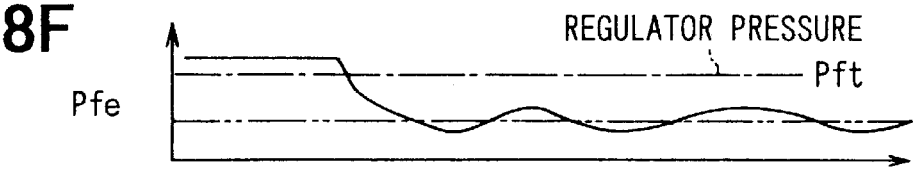

FIGS. 8A and 8B are the same as FIGS. 5A and 5B, respectively. FIG. 8C shows the duty control of the fuel pump 3 is started when both engine rotation speed NE and engine load gld become under their minimum values Refnel and Refldl, respectively. PID controller is used for the duty control to follow the set target value with good response. FIG. 8D is the same as FIG. 5D. FIG. 8E shows Fuel-Pump-Fuel-Pressure-Change-Ratio ΔPpr calculated based on the driving duty value Dutydr at several times previous routine and estimated fuel pressure Pfe(−1) at one previous routine. FIG. 8F shows an estimated fuel pressure Pfe attained based on the results in FIGS. 8D and 8E.

Here, a fuel pressure sensor may be provided to detect an actual fuel pressure. The actual fuel pressure may be used to execute the duty control instead of the fuel pressure estimation.

Figure 6:
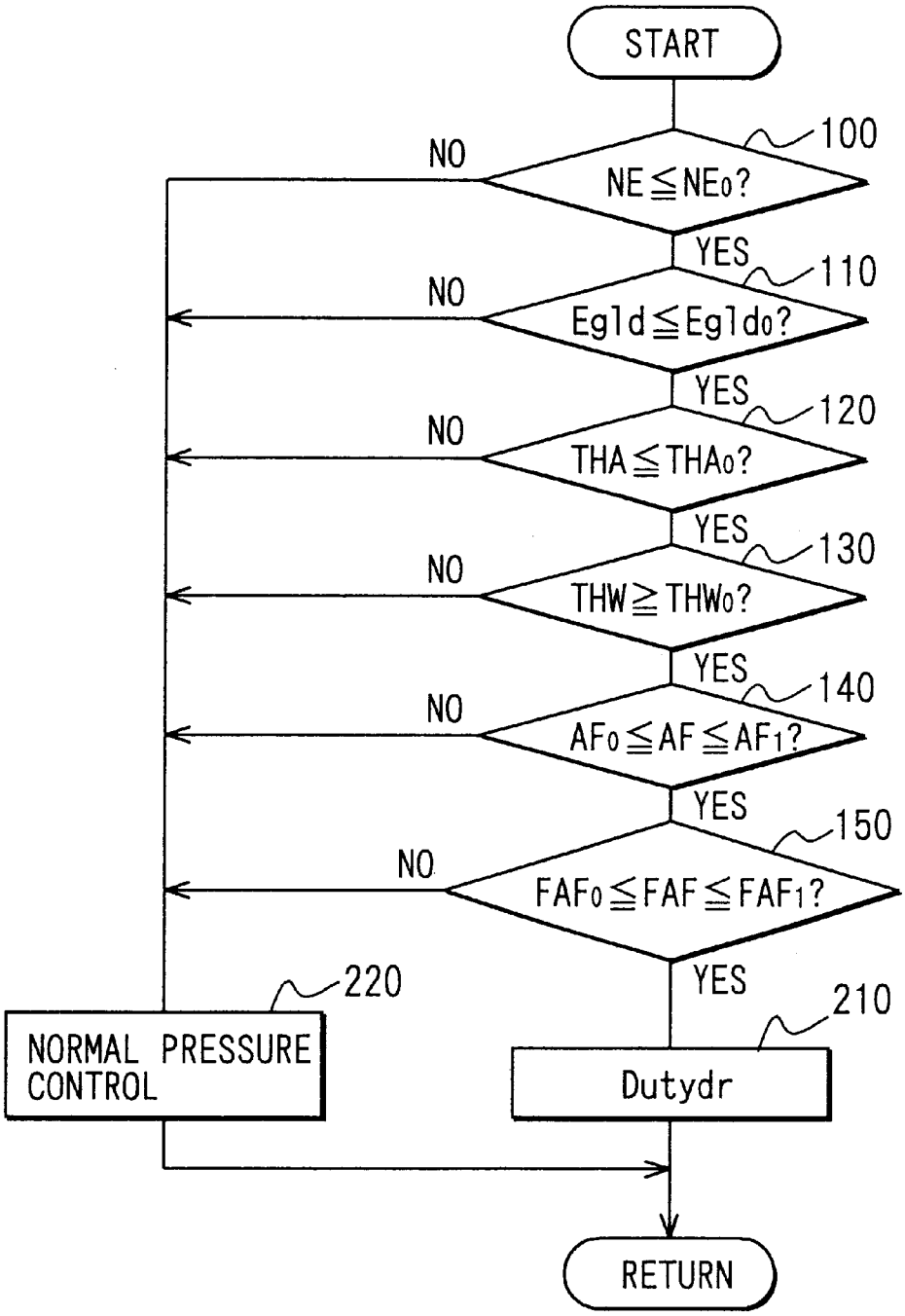
FIG. 6 is a flowchart showing a Duty Control (second embodiment)

In the second embodiment, STEP 210 in FIG. 6 and STEP 220 in FIG. 7 correspond to a pump control means. STEPS 100–150 in FIG. 6 corresponds to a operating state detection means in the present invention.

What is claimed is:

1. A fuel supply amount controller for an internal combustion engine comprising:

a fuel pump for supplying a fuel into said internal combustion engine;

a check valve for preventing the fuel from flowing back;

a fuel pressure regulation means for regulating pressure of the fuel at a predetermined fuel pressure;

a operating state detection means for detecting a operating state of said internal combustion engine; and a pump control means for controlling said fuel pump so that pressure of the fuel supplied into said internal combustion engine becomes lower than the predetermined fuel pressure when said operating state detection means detects the operating state of said internal combustion engine is within a predetermined operating state.

2. A fuel supply amount controller according to claim 1, wherein said pump control means estimates the pressure of the fuel supplied into said internal combustion engine, and feedback-controls said fuel pump so that the estimated pressure becomes a target fuel pressure lower than the predetermined fuel pressure when said operating state detection means detects the operating state of said internal combustion engine is within a predetermined operating state.

3. A fuel supply amount controller according to claim 1, further comprising a normal control means for controlling said fuel pump so that pressure of the fuel supplied into said internal combustion engine becomes higher than the predetermined fuel pressure when said operating state detection means detects the operating state of said internal combustion engine is outside the predetermined operating state.

4. A fuel supply amount controller according to claim 1, further comprising a fuel injection valve for injecting the fuel supplied from said fuel pump into said internal combustion engine, wherein said pump control means ON/OFF controls said fuel pump, said pump control means estimates fuel pressure based on ON period or OFF period of said fuel pump and an opening period of said fuel injection valve, and said pump control means controls so that the estimated fuel pressure becomes lower than the predetermined fuel pressure.

5. A fuel supply amount controller according to claim 1, further comprising a fuel injection valve for injecting the fuel supplied from said fuel pump into said internal combustion engine, wherein said pump control means duty-controls said fuel pump, said pump control means estimates fuel pressure based on a driving duty of said fuel pump and an opening period of said fuel injection valve, and said pump control means controls so that the estimated fuel pressure becomes lower than the predetermined fuel pressure.

6. A fuel supply amount controller according to claim 1, wherein said operating state detection means includes an engine temperature detection means for detecting a temperature of said internal combustion engine, and said pump control means controls said fuel pump so that pressure of the fuel supplied into said internal combustion engine becomes higher than the predetermined fuel pressure when said engine temperature detection means detects the temperature of said internal combustion engine is lower than a predetermined engine temperature.

7. A fuel supply amount controller according to claim 1, wherein said operating state detection means includes an intake air temperature detection means for detecting a temperature of an intake air, and said pump control means controls said fuel pump so that pressure of the fuel supplied into said internal combustion engine becomes higher than the predetermined fuel pressure when said intake air temperature detection means detects the temperature of said intake air is lower than a predetermined intake air temperature.

8. A fuel supply amount controller according to claim 1, wherein said operating state detection means detects the operating state of said internal combustion engine is an idle operating state, and said pump control means controls said fuel pump so that pressure of the fuel supplied into said internal combustion engine becomes lower than the predetermined fuel pressure when said operating state detection means detects the operating state of said internal combustion engine is the idle operating state.

9. A fuel supply amount controller according to claim 1, wherein said operating state detection means detects an opening of a throttle valve, and said pump control means controls said fuel pump so that pressure of the fuel supplied into said internal combustion engine becomes lower than the predetermined fuel pressure when said operating state detection means detects said throttle valve is full-closed.

10. A fuel supply amount controller according to claim 1, wherein said fuel pressure regulation means is provided between said check valve and said fuel pump.

* * * * *